US008648756B1

(12) United States Patent
Desclos et al.

(10) Patent No.: US 8,648,756 B1
(45) Date of Patent: Feb. 11, 2014

(54) MULTI-FEED ANTENNA FOR PATH OPTIMIZATION

(75) Inventors: Laurent Desclos, San Diego, CA (US); Sebastian Rowson, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 13/548,211

(22) Filed: Jul. 13, 2012

Related U.S. Application Data

(63) Continuation-in-part of application No. 13/289,901, filed on Nov. 4, 2011, and a continuation of application No. 12/894,052, filed on Sep. 29, 2010, now Pat. No. 8,077,116, and a continuation of application No. 11/841,207, filed on Aug. 20, 2007, now Pat. No. 7,830,320.

(51) Int. Cl.
*H01Q 9/16* (2006.01)

(52) U.S. Cl.
USPC ..... 343/747; 343/702

(58) Field of Classification Search
USPC ..... 343/747, 748, 795, 700 MS, 702
See application file for complete search history.

(56) References Cited

U.S. PATENT DOCUMENTS

| | | | | |
|---|---|---|---|---|
| 6,486,848 | B1 * | 11/2002 | Poilasne et al. | 343/797 |
| 6,744,410 | B2 * | 6/2004 | Shamblin et al. | 343/702 |
| 7,528,790 | B2 * | 5/2009 | Desclos et al. | 343/841 |
| 2004/0233111 | A1 * | 11/2004 | Desclos et al. | 343/700 MS |
| 2008/0111748 | A1 * | 5/2008 | Dunn et al. | 343/702 |
| 2009/0160713 | A1 * | 6/2009 | Nielsen et al. | 343/702 |
| 2011/0156975 | A1 * | 6/2011 | Pros et al. | 343/767 |

* cited by examiner

*Primary Examiner* — Hoanganh Le
(74) *Attorney, Agent, or Firm* — Coastal Patent Law Group, P.C.; Joshua S. Schoonover

(57) ABSTRACT

An antenna comprised of multiple feed ports with independent tuning of the antenna at each feed port to optimize the impedance match between the antenna and transceivers connected to the ports. Filters designed into one or several of the feed ports to provide isolation between the multiple ports and to adjust the frequency response at each port. One or multiple active components connected to the feed ports to provide dynamic tuning of the coupled or driven elements.

15 Claims, 13 Drawing Sheets

FIG.6A
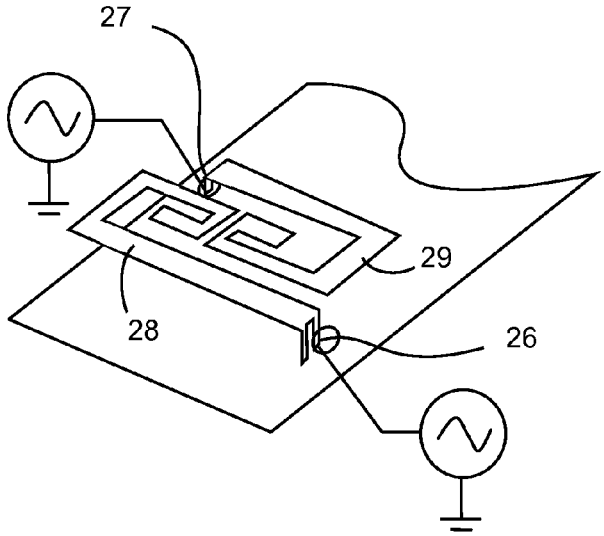
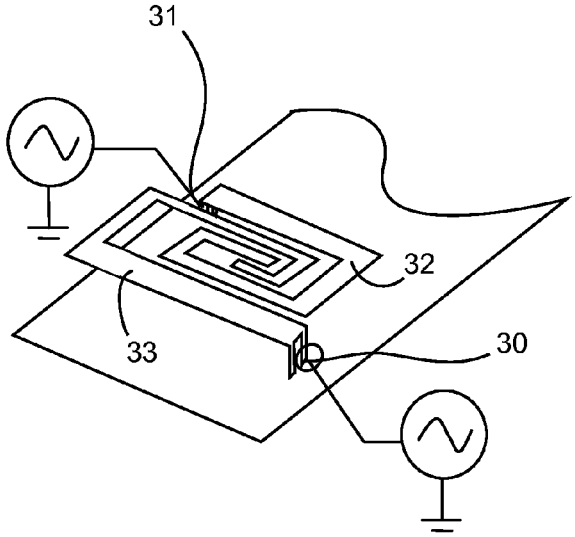
FIG.6B
FIG.6C
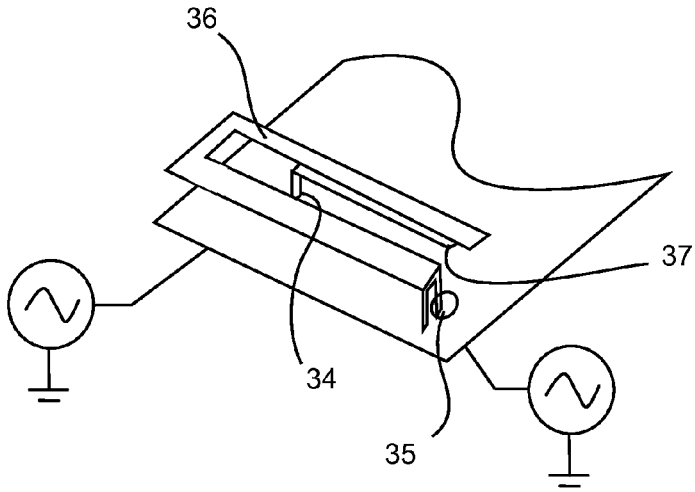

MULTI-FEED ANTENNA FOR PATH OPTIMIZATION

CROSS REFERENCE TO RELATED APPLICATIONS

This application is a CIP of U.S. patent application Ser. No. 13/289,901, filed Nov. 4, 2011, and titled "Antenna With Active Elements";

which is a CON of U.S. patent application Ser. No. 12/894,052, filed Sep. 29, 2010, and also titled "Antenna With Active Elements";

which is a CON of U.S. patent application Ser. No. 11/841,207, filed Aug. 20, 2007, and also titled "Antenna With Active Elements";

the entire contents of each of which are hereby incorporated by reference.

FIELD OF INVENTION

The present invention relates generally to the field of wireless communication. In particular, the present invention relates to antennas and methods of improving frequency response and selection for use in wireless communications.

BACKGROUND OF THE INVENTION

Commonly Owned U.S. Pat. Nos. 7,339,531, awarded Mar. 4, 2008 entitled "Multi Frequency Magnetic Dipole Antenna Structures and Method of Reusing the Volume of an Antenna"; 6,943,730 awarded Sep. 13, 2005 entitled "Low-Profile Multi-Frequency, Multi-Band, Capacitively Loaded Magnetic Dipole Antenna"; 6,919,857 awarded Jul. 19, 2005 entitled "Differential Mode Capacitively Loaded Magnetic Dipole Antenna"; 6,900,773 awarded May 31, 2005 entitled "Active Configurable Capacitively Loaded Magnetic Dipole"; 6,859,175 awarded Feb. 22, 2005 entitled "Multiple Frequency Antennas With Reduced Space and Relative Assembly"; 6,744,410 awarded Jun. 1, 2004 entitled "Multi-Band, Low Profile, Capacitively Loaded antennas With Integrated Filters"; and 6,323,810 awarded Nov. 27, 2001 entitled "Multimode Grounded Finger Patch Antenna; and commonly owned co-pending U.S. patent application Ser. No. 11/847,207, filed Aug. 20, 2007, entitled "Antenna With Active Elements,"; and commonly owned co-pending U.S. patent application Ser. No. 12/059,346, filed Mar. 31, 2008, entitled "Multilayer Isolated Magnetic Dipole Antenna," describe various embodiments of an Isolated Magnetic Dipole (IMD) antenna, their entire contents are hereby incorporated by reference.

The IMD antenna, as illustrated in FIGS. 1*a*-1*b*, may comprise a first portion 1, a second portion 2 and a connecting portion 3 therebetween, the first portion and second portion being separated by a gap, wherein the first portion, second portion and connecting portion are substantially disposed within a common plane, and wherein the first portion and second portion are substantially parallel with respect to one another. The geometry of the IMD antenna provides a planar inductive loop 4, and the gap between the first and second portions of the IMD antenna further provides a capacitive loading of the inductive loop, thereby creating a magnetic dipole mode. A feed connects the antenna to a circuit board. In the various embodiments of IMD antennas referenced above, a single resonance IMD antenna can be provided as illustrated in FIG. 1*a*. Alternatively, a dual resonance IMD antenna can be provided as illustrated in FIG. 1*b*, wherein the dual resonance antenna comprises a first radiating portion and a second radiating portion, as well as a feed for connecting the antenna to ground.

The magnetic dipole mode of the IMD antenna provides a single or dual resonance and forms an antenna that is efficient and well isolated from the surrounding structure. The dual resonance frequency response can be impedance matched to provide quad or penta-band coverage, allowing for reception, for example, over the 850 GSM, EGSM, DCS, PCS, and WCDMA bands for cellular use. This is, in effect, a self resonant structure that is de-coupled from the local environment. This antenna typically has a single feed for connection of the antenna to the transceiver.

As additional frequency bands are required in the wireless device, tradeoffs are made in terms of matching the single feed antenna structure to a transceiver containing multiple power amplifiers (PA) and receivers. The single feed IMD structure, as described by the prior art, designed to contain two or more resonances that are optimized to provide a radiating structure to service low band (850 GSM and EGSM bands in a handset for example) and high band (DCS, PCS, UMTS) frequency requirements, cannot be optimized for such effects as de-tuning due to the user's head or hand as these effects vary greatly as a function of frequency. Another limitation of the prior art IMD structures includes the difference in transmit power required for GSM and CDMA systems. If active components are integrated into the antenna structure for dynamic tuning, high power components are required in the single feed antenna even when CDMA is operating.

The antenna can be optimized if two or more feed connections can be designed into the single, common antenna structure. This will allow for optimization of the antenna for two or more sets of PAs. An alternate strategy can be provided, where low power CDMA bands are implemented on one feed connection, while higher power GSM bands can be implemented on the second feed connection. This will allow for a combination of low and high power active components to be used on the same antenna structure to dynamically tune or adjust the frequency response of the antenna.

Accordingly, there is a need in the art for an antenna optimized for use with two or more power amplifiers or receivers. There is further a need for an optimized antenna having dual feeds for implementing low power CDMA bands in addition to high power GSM bands. There is also a continuing need for antennas optimized for operation over multiple bands, and designed to function in the presence of interferences associated with the human body. Finally, there remains a need in the art for an antenna system capable of operation over multiple bands, where the antenna is optimized for volume, loss, and cost of manufacture.

SUMMARY OF THE INVENTION

An object of the invention is therefore to solve the forgoing problems, and to provide an antenna that includes two or more antenna feed ports to provide a method of optimizing the antenna across multiple frequency bands. The feed ports may be connected to separate transceivers. The antenna comprises one or more radiating structures positioned within a common volume.

In certain embodiments, the radiating structures can each comprise one or more feed ports, such that the antenna formed by the one or more radiating structures positioned within a common volume includes two of more feed ports.

In one embodiment, an IMD antenna including a single conductive structure having two feed ports is provided. The dual feed port IMD antenna is designed to operate at low frequencies at a first feed port, and to operate at high frequencies at a second feed port. Alternatively, the antenna can be designed to provide an alternate function, wherein low power frequency bands are transmitted from the first feed port and higher power frequency bands transmitted from the second port. The antenna therefore provides for optimal component selection and antenna performance.

The antenna can comprise one or more filters for varying frequency response. The filters can comprise a conductive portion with one or more slots positioned along the length of the conductive portion. The slots can be arranged in a number of patterns, such that the reactance of the conductive portion can be adjusted to vary the frequency response of the conductive portion. A number of slotted patterns are disclosed for varying the reactance of the conductive portion.

In another embodiment, an antenna comprises a first IMD radiating structure having a substantially planar radiating portion, and a second IMD radiating structure having a substantially planar radiating portion, wherein the second IMD radiating structure is smaller in size and positioned between the first IMD radiating structure; i.e. the radiating structures are concentrically disposed. In this embodiment, the antenna comprises a first feed port electrically connected to the first IMD radiating structure, and a second feed port electrically connected to the second IMD radiating structure.

The IMD radiating structures can be single resonance IMD structures. Alternatively, the IMD radiating structures can be dual resonance IMD structures. Still further, the IMD radiating structures can be any variation or combination of IMD radiating structures so long as these structures physically fit within a common volume.

In another embodiment, an antenna comprises a first IMD radiating structure having a substantially planar radiating portion, and a second IMD radiating structure having a substantially planar radiating portion, wherein the second IMD radiating structure is positioned near, and at least partially shares a common volume with the first IMD radiating structure. In this embodiment, the antenna comprises a first feed port electrically connected to the first IMD radiating structure, and a second feed port electrically connected to the second IMD radiating structure.

In yet another embodiment, an antenna is provided having a first radiating structure and a second radiating structure positioned in near-proximity to the first radiating structure. The first radiating structure is an IMD radiating structure, and comprises a first feed port. The second radiating structure can be a planar strip conductor or a wire and comprises a second feed port. The second radiating structure is capacitively coupled to the first IMD radiating structure, the coupling thereby enabling a second feed to the IMD radiating structure.

In various embodiments, the first radiating structure and second radiating structure can be designed such that the first radiating structure and second radiating structure are positioned within a common plane, and share a common volume. In other embodiments, the first radiating structure and second radiating structure are positioned in separate planes, and share a common volume.

Another embodiment illustrates a first IMD radiating structure positioned on a top surface of a thermoformed carrier, and a second radiating structure positioned on a bottom surface of a thermoformed carrier, the first IMD radiating structure capacitively coupled to the second radiating structure, wherein the first IMD radiating structure includes a first feed port and the second radiating structure includes a second feed port, such that the antenna comprises at least two feed ports. A second thermoformed carrier having a third and fourth radiating structure can be combined with the first thermoformed carrier such that an antenna is formed having multiple radiating structures and multiple feed ports.

Other embodiments are disclosed, illustrating three or more radiating structures, wherein two or more feed ports are provided, the two or more feed ports connected to various power amplifiers or receivers for dynamically tuning the frequency response of the antenna.

BRIEF DESCRIPTION OF THE DRAWINGS

FIGS. 6(*a-b*) illustrate a perspective view of two isolated magnetic dipole (IMD) radiating structures, each radiating structure having one feed port; wherein the IMD radiating structures are positioned near one another.

FIG. 6*c* is a perspective view of a two port IMD antenna, where a second structure is used to couple to a portion of an IMD structure.

DETAILED DESCRIPTION OF THE PREFERRED EMBODIMENTS

Figure 1A:
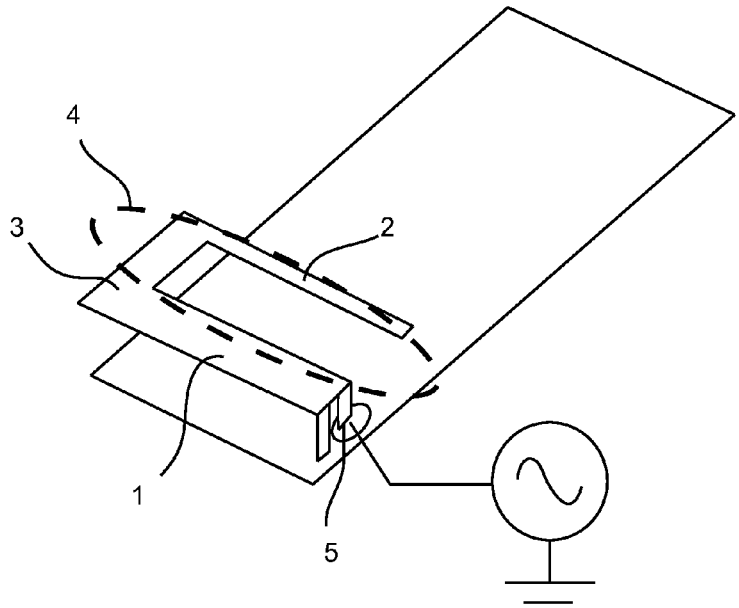
FIG.1A (Prior Art)
FIG. 1*a* illustrates a perspective view of a single resonance isolated magnetic dipole (IMD) antenna, as commonly owned and disclosed in the prior art, the IMD antenna consists of one feed port that supports a single frequency resonance.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

Figure 1B:
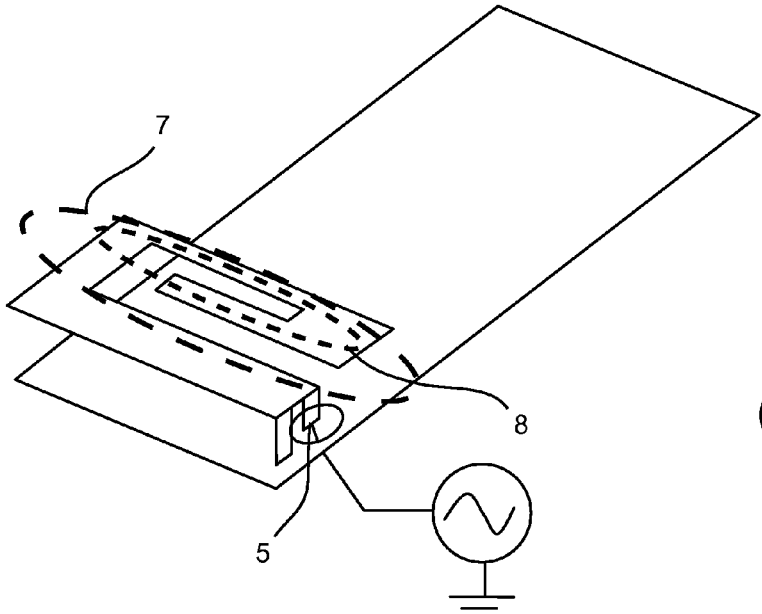
FIG.1B (Prior Art)
FIG. 1*b* illustrates a perspective view of a dual resonance isolated magnetic dipole (IMD) antenna, as commonly owned and disclosed in the prior art, the IMD antenna consists of one feed port that supports both a low and a high frequency resonance.

With reference to FIGS. 1(*a-b*), the Isolated Magnetic Dipole (IMD) antenna, described in a number of commonly-owned US Patents as referenced above, generally includes a first portion 1, a second portion 2, and a connecting portion 3 therebetween, the first portion 1 and second portion 2 being separated by a gap, wherein the first portion 1, second portion 2, and connecting portion 3 are substantially disposed within a common plane, and wherein the first portion 1, and second portion 2 are substantially parallel with respect to one another. The geometry of the IMD antenna provides a planar inductive loop 1,2,3, and the gap between the first and second portions of the IMD antenna further provides a capacitive loading of the inductive loop, thereby creating a magnetic dipole mode. As referenced above, various embodiments of IMD antennas include: a single resonance IMD antenna as illustrated in FIG. 1*a*, and a dual resonance IMD antenna as illustrated in FIG. 1*b*.

FIG. 1*a* illustrates a single resonance IMD antenna, the IMD antenna having a single feed port 5 and having a single resonance denoted by the large oval region 4.

FIG. 1*b* illustrates a dual resonance isolated magnetic dipole (IMD) antenna with one feed port 5. The portion of the antenna that supports radiation at the low frequency resonance is denoted by the large oval region 7, while the portion of the antenna that supports radiation at the high frequency resonance is denoted by the small oval region 8.

As indicated in the forgoing description, IMD antennas having a single feed port have been disclosed in the prior art. This invention provides various improvements and embodiments of IMD antennas having two or more feed ports. The two or more feed ports can be used for optimization of the antenna for two or more sets of power amplifiers (PA's) or receivers. Additionally, the two or more feed ports can be used for providing low power CDMA bands implemented on a first feed connection, while higher power GSM bands are implemented on a second feed connection; thereby allowing for a combination of low and high power active components to be used on the same antenna structure to dynamically tune or adjust the frequency response of the antenna.

Figure 2:
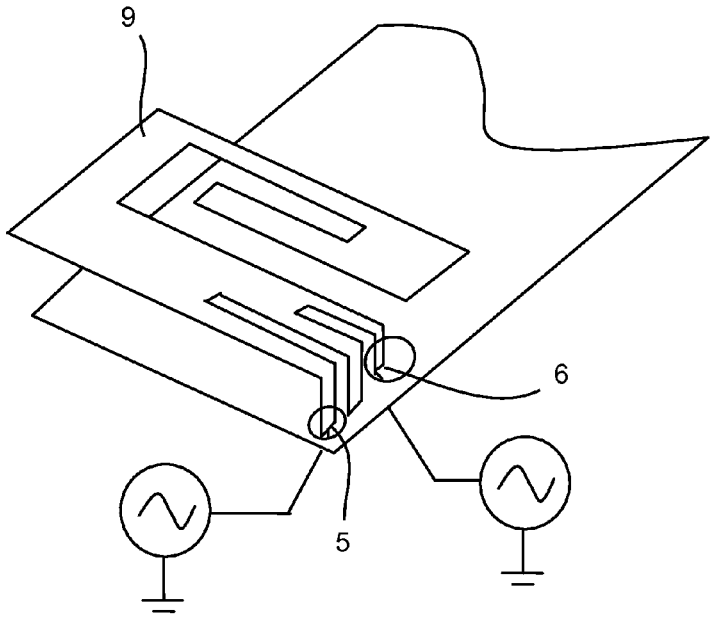
FIG. 2 illustrates a perspective view of one embodiment of the invention wherein a dual resonance isolated magnetic dipole (IMD) antenna is provided having two feed ports for connecting the antenna to separate transceivers.

With reference to FIG. 2, an isolated magnetic dipole (IMD) antenna 9 with two feed ports 5; 6 is provided. The feed ports can be connected to separate transceivers. In this embodiment, an antenna is provided having a first portion, a second portion, and a connecting portion therebetween. A third portion is positioned between the first and second portions, and a second connecting portion connects the third portion to the second portion. Each of the first, second, and third portions, and their respective connecting portions, are positioned within a common plane. The first portion is further positioned substantially parallel to the second and third portions, and the first portion has a length greater than the third portion. The first portion comprises a first feed and a common ground connection separated by a first feed gap. The first portion further comprises a second feed separated from the common ground connection by a second feed gap. The first feed and second feed ports are positioned on opposite sides of the common ground connection.

The first and second feed gaps can be disposed substantially vertically, or can be disposed along a planar length of the first portion as illustrated in FIG. 2. The first feed gap and second feed gap can be disposed along a common length of the first portion of the IMD radiating structure. Alternatively, the first feed gap and second feed gap can be disposed along different lengths of the first portion of the radiating structure.

Figure 3A:
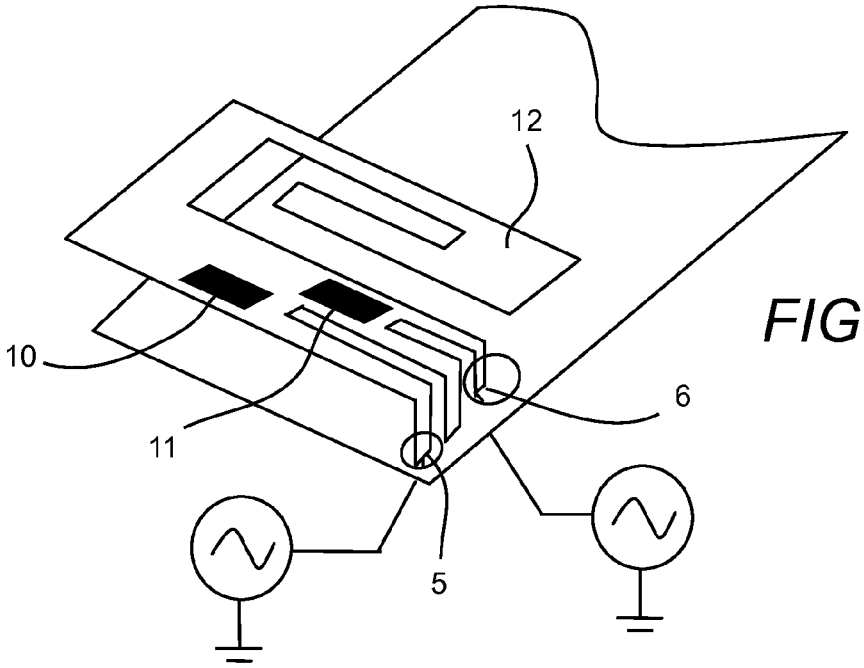
FIG. 3*a* illustrates a perspective view of an antenna in one embodiment of the invention, wherein a dual resonance isolated magnetic dipole (IMD) antenna is provided having two feed ports and one or more filters integrated into the antenna element.

Referring now to FIG. 3*a*, an isolated magnetic dipole (IMD) antenna is provided having two feed ports 5 and 6 and with filters 10 and 11 integrated into the antenna element 12. The feed ports can be connected to separate transceivers.

Figure 3B:
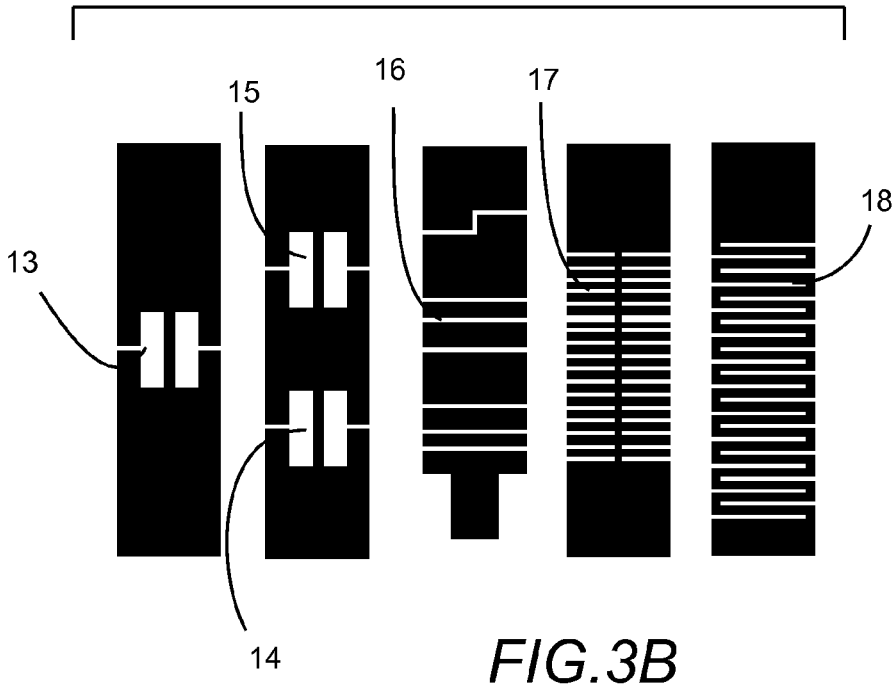
FIG. 3*b* illustrates a top view of several filters, each filter comprising a conductive portion with one or more slots for providing distributed reactance of the conductive portion.

Several types of filters comprising a conductive portion with one or more slots for distributing reactance of the conductive portion are shown in FIG. 3*b*. The distributed reactance can be adjusted to alter the frequency response of the conductive portion. A distributed LC section 13 is designed into a conductive element. Two distributed LC sections 14 and 15 are designed into a single conductive element. A series of capacitive sections are formed by coupling regions 16 designed into a conductive element. An embodiment for reducing the frequency of operation is shown in the design 17 incorporated into a conductive element. Another embodiment for applying a distributed LC circuit is shown in pattern 18.

Figure 4:
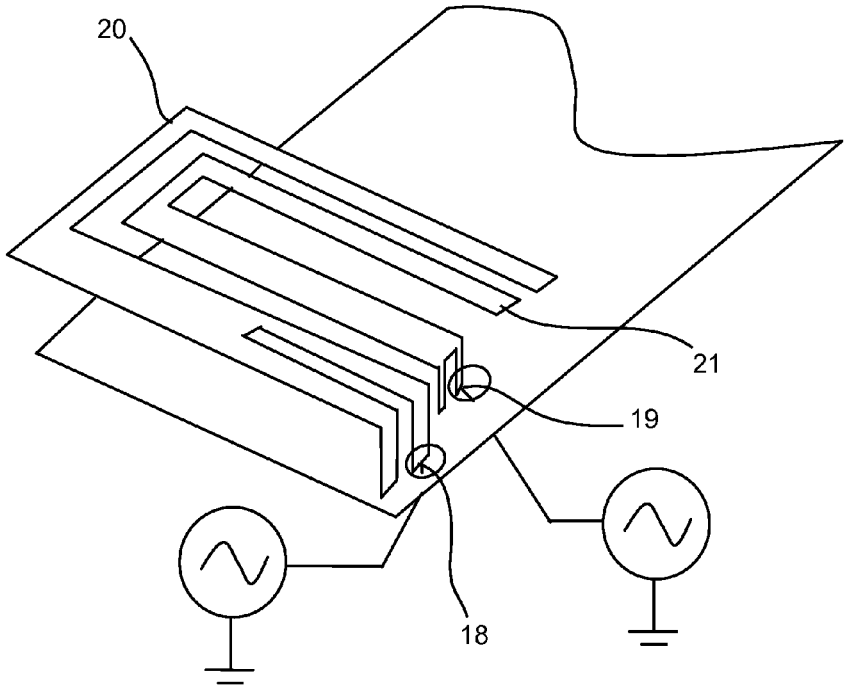
FIG. 4 illustrates a perspective view of an embodiment of the invention, wherein an antenna is provided having two single resonance isolated magnetic dipole (IMD) radiating structures, each with one feed port; wherein the IMD radiating structures occupy a common volume.

FIG. 4 illustrates an antenna including two single resonance isolated magnetic dipole (IMD) radiating structures 20 and 21 each with one feed port 18 and 19 respectively. The IMD radiating structures 20 and 21 occupy the same volume and are in the same plane. The outer radiating structure 20 and the inner radiating structure 21 are concentrically disposed one within the other. Each radiating structure includes a feed gap disposed between a feed port and a ground connection.

Figure 5:
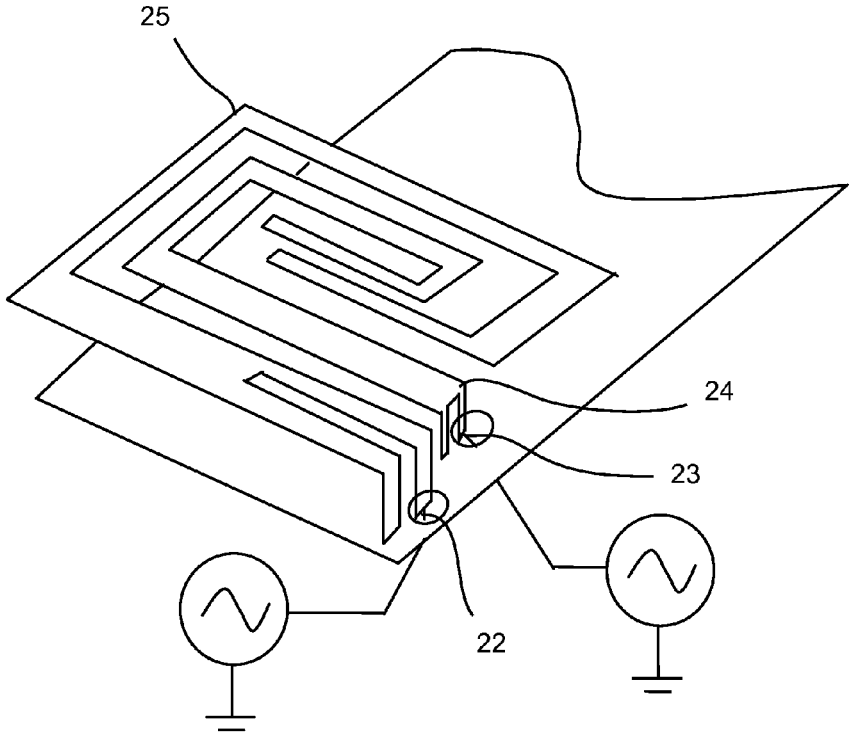
FIG. 5 illustrates a perspective view of an antenna having two dual resonance isolated magnetic dipole (IMD) radiating structures, each radiating structure having one feed port; wherein the IMD antennas occupy a common volume.
Figure 7A:
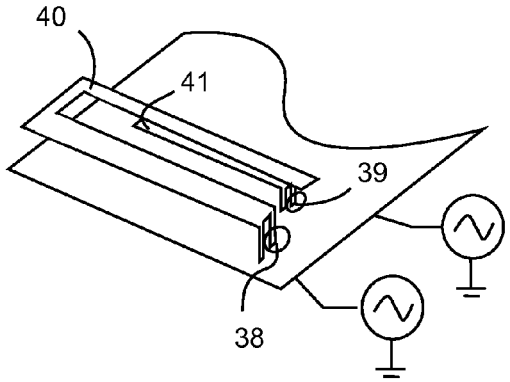
FIGS. 7(*a-d*) illustrate an antenna in a perspective view, wherein several embodiments of coupling one or more radiating structures to single or dual resonance IMD structures are provided; the additional radiating structures provide additional feed ports for the IMD antenna.
Figure 7B:
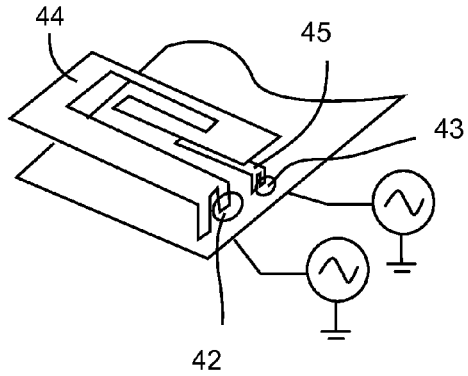
Figure 7C:
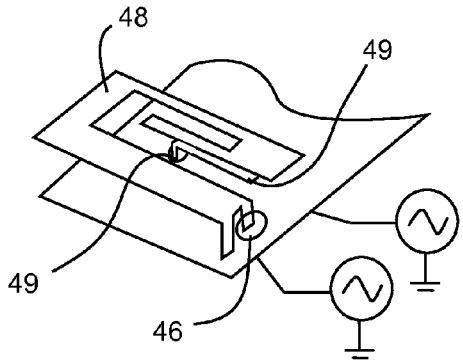
Figure 7D:
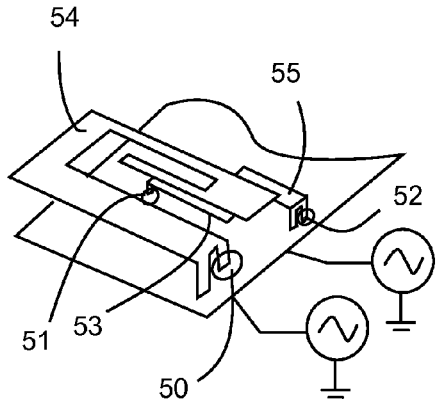

In another embodiment, as illustrated in FIG. 5, two dual resonance isolated magnetic dipole (IMD) radiating structures 24 and 25 each with one feed port 23 and 22, respectively, are positioned within a common plane and at least partially share a common volume. The dual resonance IMD structures are concentrically disposed. Each IMD radiating structure includes a first portion, second portion, and third portion; wherein the first portion is connected to the second portion by a connecting portion positioned at a distal end relative to the antenna feed; and wherein the second portion is connected to the third portion by a second connecting portion at a proximal end relative to the antenna feed. The first IMD radiating structure is larger than the second IMD radiating structure such that the second radiating structure can be positioned between the portions of the first IMD radiating structure, thereby sharing a common volume.

For purposes of the IMD structures illustrated herein, the antenna volume is defined as the three-dimensional space between the antenna conductors and the circuit board.

FIG. 6(*a*) illustrates an antenna system including two isolated magnetic dipole (IMD) radiating structures 28 and 29, each radiating structure having one feed port, 26 and 27, respectively. The IMD radiating structures are closely spaced and are in the same plane. The first and second IMD radiating structures at least partially share a common volume.

FIG. 6(*b*) illustrates another embodiment wherein two isolated magnetic dipole (IMD) radiating structures 32 and 33 each include one feed port, 30 and 31 respectively. The IMD radiating structures 32 and 33 are interlaced and in the same plane. In this embodiment, an antenna system is provided, the antenna including a first and second IMD radiating structure. The first radiating structure includes a vertical feed region and a first portion extending longitudinally planar from the vertical feed region. The first portion includes a proximal end, and a distal end with respect to the vertical feed region. The second IMD radiating structure includes a vertical feed region positioned distal to the vertical feed region of the first IMD radiating structure. The first and second IMD radiating structures at least partially share a common volume.

FIG. 6(*c*) illustrates an embodiment of an antenna system, the antenna having a single resonance isolated magnetic dipole (IMD) radiating structure 36 with a feed port 35. A second structure 37 is positioned below the IMD element, thereby providing an additional feed port 34 as a result of the coupling between the IMD structure 36 and the second structure 37.

As illustrated in FIG. 7(*a*), another embodiment of an antenna system is provided, the antenna including an isolated magnetic dipole (IMD) radiating structure 40 with a feed port 38. A second element 41 is located below the IMD element providing an additional feed port 39 as a result of the coupling between the IMD antenna 40 and the second element 41. This antenna system creates a low band frequency resonance with two feed ports.

FIG. 7(*b*) illustrates another embodiment of an antenna system including an isolated magnetic dipole (IMD) radiating structure 44 with a feed port 42. A second radiating structure 45 is located below the IMD structure providing an additional feed port 43 as a result of the coupling between the IMD structure 44 and the second structure 45. This structure creates a high band frequency resonance with two feed ports.

FIG. 7(*c*) illustrates another embodiment of an antenna system, the antenna including an isolated magnetic dipole (IMD) radiating structure 48 with a feed port 46. A second structure 49 is positioned below the IMD structure providing an additional feed port 47 as a result of the coupling between the IMD structure 48 and the second element 49. This antenna system creates a high band frequency resonance with two feed ports. In this embodiment, the second structure provides a feed region located distal to the feed region of the IMD radiating structure for further optimizing the tuning of the antenna system.

FIG. 7(*d*) illustrates another embodiment including an isolated magnetic dipole (IMD) radiating structure 54 with a feed port 50. A second structure 53 is located below the IMD structure providing an additional feed port 51 as a result of the coupling between the IMD structure 54 and the second structure 53. A third structure 55 is located below the IMD structure providing an additional feed port 52 as a result of the coupling between the IMD structure 54 and the third structure 55. This system creates both high and low band frequency resonances with three feed ports. Additionally, the three feed ports are spaced apart to optimize the frequency response of the antenna.

Figure 8A:
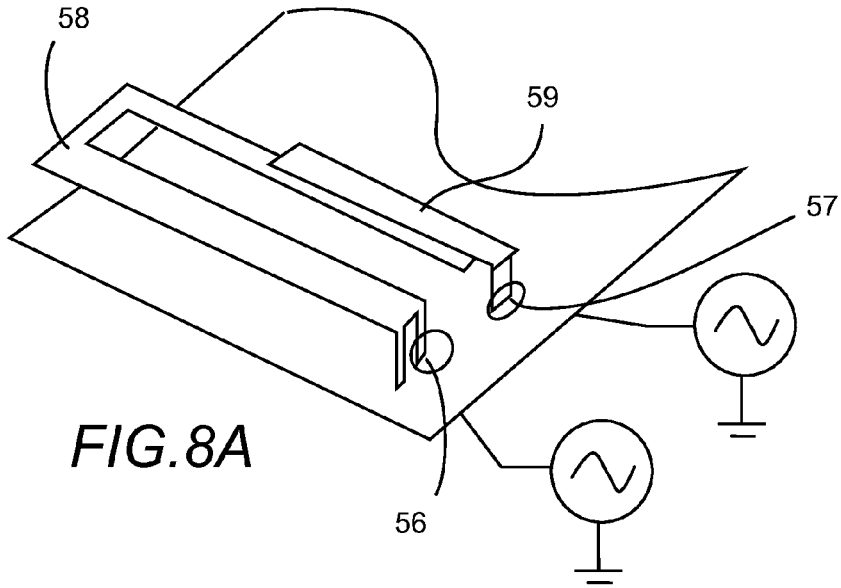
FIGS. 8(*a-b*) illustrate a perspective view of an antenna, wherein additional radiating structures are coupled to single or dual resonance IMD structures; the additional structures shown are positioned above and below the IMD structure and provide additional feed ports for the IMD antenna.
Figure 8B:
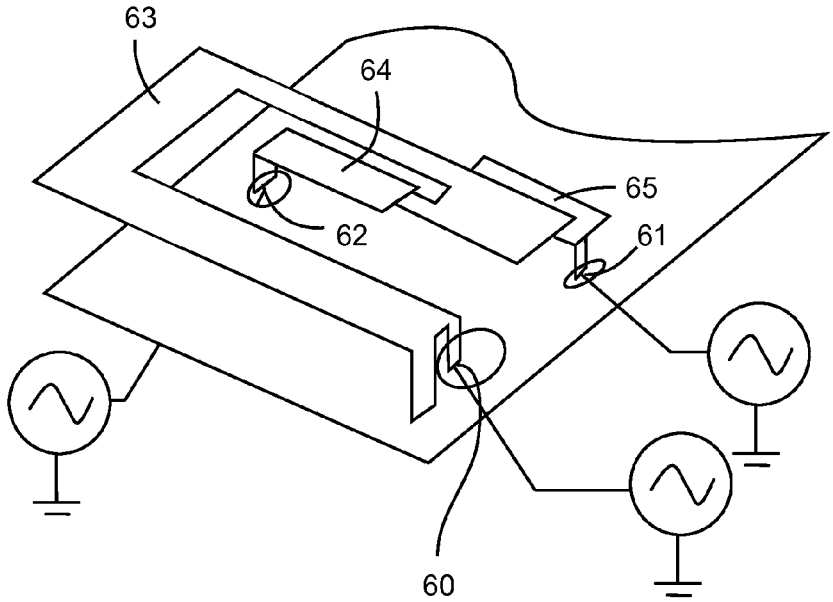

Now referring to FIG. 8(*a*), an antenna system is provided having two separate feed points 56 and 57 each connected to radiating structures 58 and 59 respectively in different vertical planes creating two low frequency resonances.

FIG. 8(*b*) illustrates another embodiment where an isolated magnetic dipole (IMD) radiating structure 63 includes a feed port 60. A second structure 64 is located above the IMD element providing an additional feed port 62 as a result of the coupling between the IMD structure 63 and the second structure 64. A third structure 65 is located below the IMD structure providing an additional feed port 61 as a result of the coupling between the IMD structure 63 and the third structure 65. This system creates both high and low band frequency resonances with three feed ports.

Figure 9:
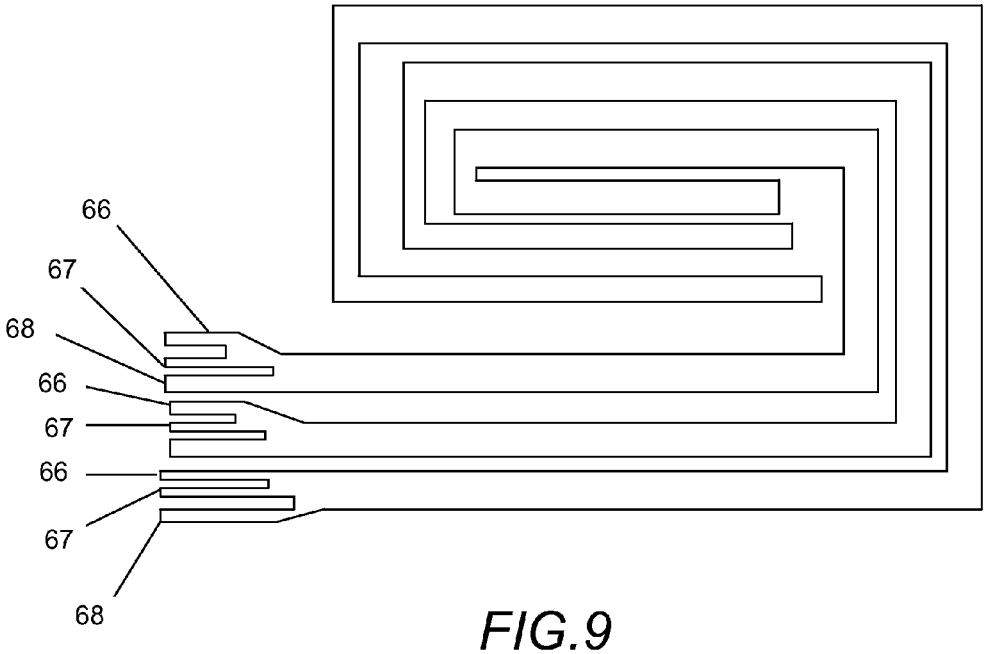
FIG. 9 is a planar view of three isolated magnetic dipole (IMD) radiating structures interlaced within a common volume; each radiating structure having multiple feed ports and a common ground connection.

FIG. 9 provides an example of three dual-resonance isolated magnetic dipole (IMD) radiating structures being concentrically disposed and each having two feed ports 66 and 68 and a common ground 67. The first outer IMD radiating structure is larger than the second middle IMD radiating structure; and the second middle IMD radiating structure is larger than the third inner IMD radiating structure; such that each of the concentrically disposed structures are interlaced and configured within a common volume.

The antenna structures can be positioned within free space, or alternatively can be positioned within a volume of material. In one example, a plastic thermoformed carrier can be fabricated having a top surface and a bottom surface. A first radiating structure, such as an IMD radiating structure, can be positioned on the top surface of the thermoformed carrier. A second radiating structure can be positioned on the bottom surface of the radiating structure. The first radiating structure and second radiating structure each comprising at least one feed, and a ground connection. The radiating structures can be vertically separated by the thickness of the thermoformed carrier.

Figure 10:
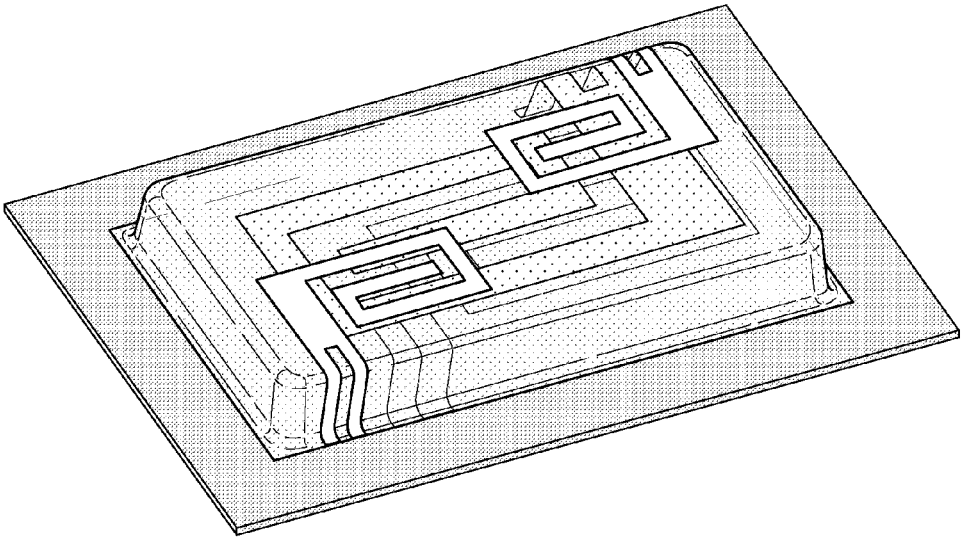
FIG. 10 is a perspective view of four isolated magnetic dipole (IMD) structures each with one feed port; the IMD structures are attached to a plastic layer which provides a low cost method of co-locating multiple antennas in a common volume.

In another embodiment, two thermoformed carriers can be provided, each having a radiating structure positioned on the top and bottom surface of the carrier. FIG. 10 illustrates an integrated antenna assembly comprising two thermo-formed plastic carriers, one on top of the other, with conductive antenna structures attached to both the top and bottom side of each thermo-formed plastic carrier. These four single-feed IMD antennas occupy a common volume. Each feed can be connected to a separate transceiver.

Figure 11:
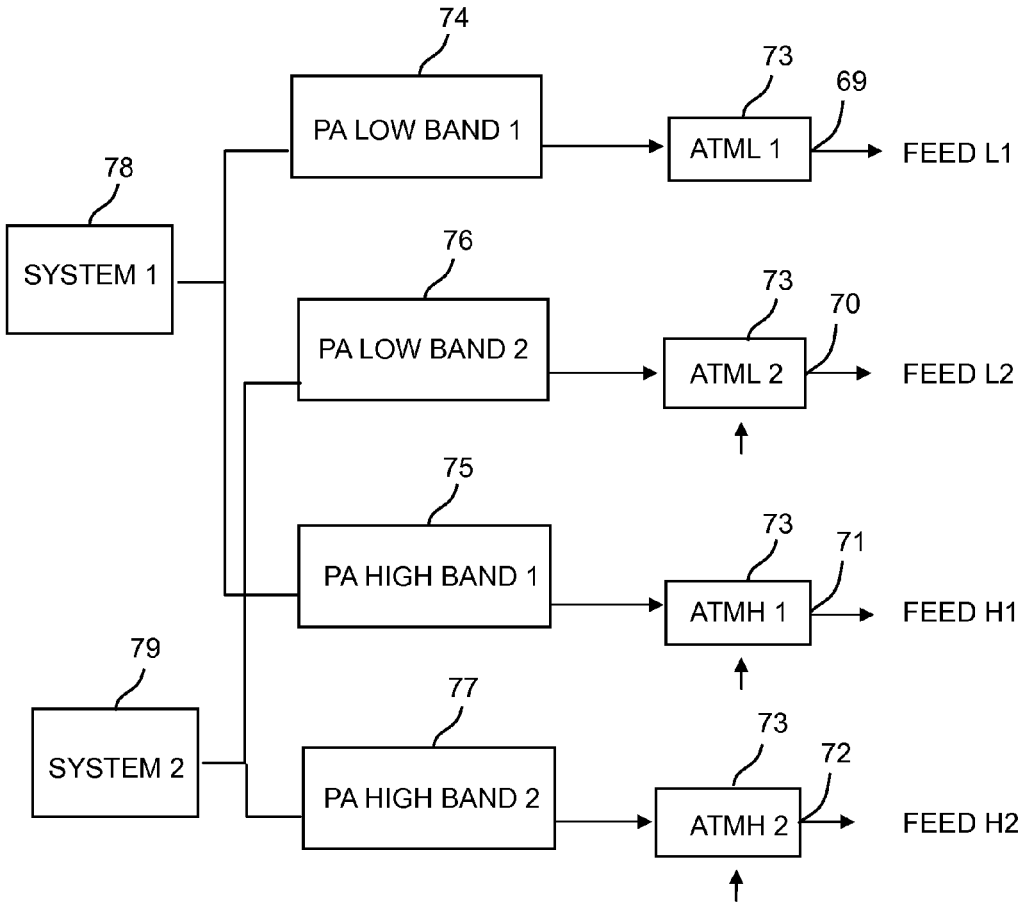
FIG. 11 illustrates a block diagram of an antenna system that comprises multiple feed ports, with low and high frequency band ports; each feed port has an antenna tuning module (ATM) for frequency adjustment and impedance matching; and each ATM is connected to a power amplifier, with one low band feed port and one high band feed port connected to a system input, designated "system 1" or "system 2"; wherein the system inputs can represent transceivers.

FIG. 11 illustrates an antenna system that comprises four feed ports; two low frequency band ports 69, 70 and two high frequency band ports 71, 72. Each feed port has an antenna tuning module (ATM) 73 for frequency adjustment and impedance matching. Each ATM is connected to a power amplifier; with one low band feed port 74, 76 and one high band feed port 75, 77 connected to a system input, designated "System 1" 78 or "System 2" 79. The system inputs can represent transceivers.

Figure 12:
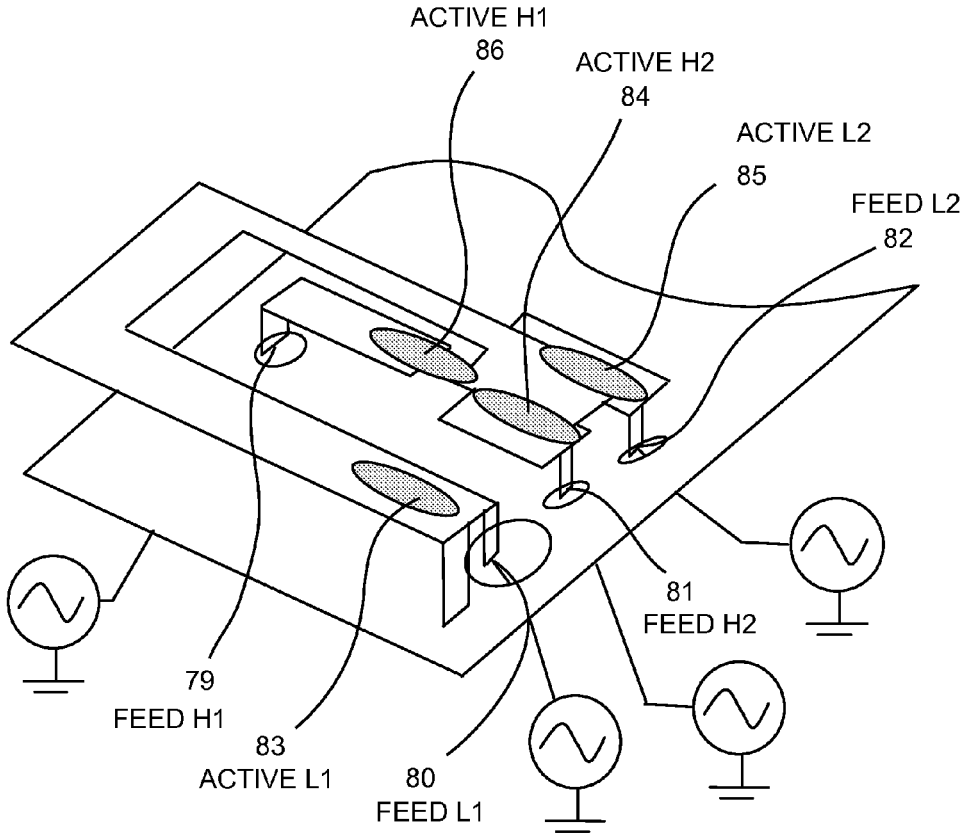
FIG. 12 is a perspective view of an antenna including an isolated magnetic dipole (IMD) radiating structure coupled to three planar radiating structures each having a feed port, the four-port IMD antenna allowing for frequency optimization for each feed port; and a connection to a transceiver at each feed port.

An Antenna Tuning Module may generally include an active circuit connected to the antenna, the active circuit including various active and passive components. Examples of active components include switches, tunable capacitors, diodes, and others known in the art. Passive components generally include capacitors, inductors, and others known in the art. The antenna tuning module can be developed specific to a particular antenna for operation over targeted frequency bands. The active tuning module (ATM) is directly connected to the antenna FIG. 12 illustrates an antenna comprising an isolated magnetic dipole (IMD) radiating structure with two high frequency feed ports 79, 81 and two low frequency feed ports 80, 82. Active components 83, 84, 85 and 86 are coupled or attached to the antenna structure, allowing for frequency optimization for each feed port. A transceiver is connected to each feed port.

Active components may include NPN transistors, variable capacitors, varactor diodes, MOSFET, switches, and other similar components.

Figure 13:
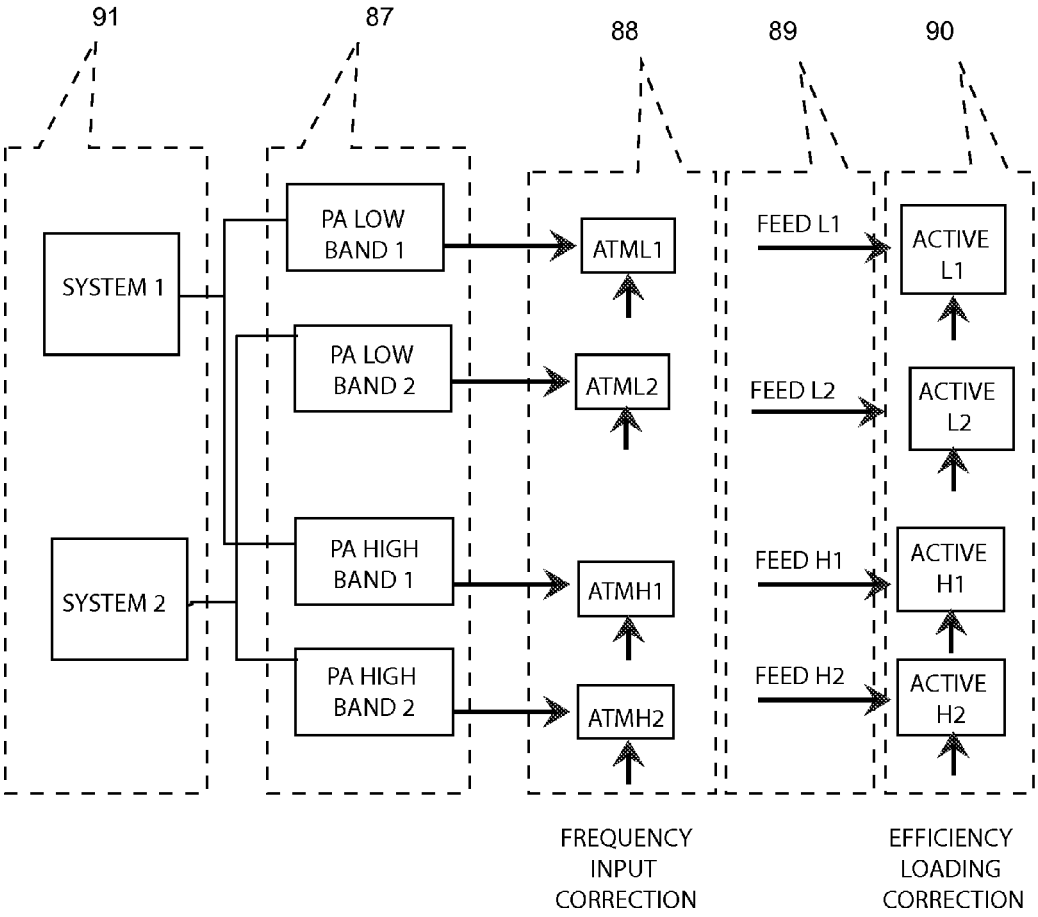
FIG. 13 illustrates a block diagram of an antenna system that comprises multiple feed ports, with low and high frequency band ports; at each feed port, active components labeled "ActiveL1" through "ActiveH2" are attached to the antenna structure to optimize antenna efficiency; each feed port has an antenna tuning module (ATM) for frequency adjustment and impedance matching; and each ATM is connected to a power amplifier, with one low band feed port and one high band feed port connected to a system input, designated "system 1" or "system 2"; wherein the system inputs can represent transceivers.

FIG. 13 illustrates an antenna system that consists of four feed ports; two low frequency band ports and two high frequency band ports 89. At each feed port, active components labeled "ActiveL1" through "ActiveH2" 90 are attached to the antenna structure to optimize antenna efficiency by loading correction. Each feed port has an antenna tuning module (ATM) 88 for frequency adjustment and impedance matching. Each ATM is connected to a power amplifier, with one low band feed port one high band feed port 87 connected to a system input, designated "System 1" or "System 2" 91. The system inputs can represent transceivers.

As described above, although the present invention is described in detail using the preferred embodiments, the present invention is not limited thereto. It will be obvious to those skilled in the art that numerous modified preferred embodiments and altered preferred embodiments are possible within the technical scope of the present invention as defined in the following appended claims.

What is claimed is:

1. An antenna, comprising:

an isolated magnetic dipole antenna element comprising a first feed port and a second feed port;

said first feed port of the antenna configured to connect to a first power amplifier;

said second feed port of the antenna configured to connect to a second power amplifier;

wherein each of said first and second feed ports are configured to optimize the impedance properties of the antenna.

2. The antenna of claim 1, said isolated magnetic dipole antenna element comprising one or more filters, wherein said filters are designed into one or multiple feed ports to provide isolation between the feed ports.

3. The antenna of claim 1, further comprising an antenna tuning module, said antenna module being connected to said first and second feed ports of the antenna element.

4. The antenna of claim 3, comprising two or more antenna tuning modules.

5. The antenna of claim 1, comprising two or more isolated magnetic dipole elements being concentrically disposed and occupying a common antenna volume.

6. The antenna of claim 5, wherein each of said elements comprises two or more feed ports.

7. The antenna of claim 1, wherein said first feed port is adapted to communicate low frequency signals and said second feed port is adapted to communicate high frequency signals.

8. An antenna system, comprising:

a first isolated magnetic dipole radiating structure having at least one resonance portion;

a second isolated magnetic dipole radiating structure having at least one resonance portion;

said first and second isolated magnetic dipole radiating structures being concentrically disposed within a common plane and at least partially sharing a common antenna volume;

said first isolated magnetic dipole radiating structure having a first feed point connected to a first power amplifier, and said second isolated magnetic dipole radiating structure having a second feed point connected to a second power amplifier;

wherein the antenna system is configured for path optimization between the first and second feeds.

9. The antenna system of claim 8, wherein the first isolated magnetic dipole radiating structure is connected to a first antenna tuning module, and wherein the second isolated magnetic dipole radiating structure is connected to a second antenna tuning module.

10. The antenna system of claim 9, wherein said antenna system is adapted for dynamic tuning across multiple frequencies.

11. An antenna system, comprising:

an isolated magnetic dipole antenna positioned above a circuit board and forming an antenna volume therebetween, the isolated magnetic dipole antenna having a first feed port thereof;

a second antenna element at least partially disposed within the antenna volume, the second antenna element having a second feed port;

the first feed port configured to connect to a first power amplifier; and the second feed port configured to connect to a second power amplifier;

wherein the antenna system is configured for multiple feed path optimization.

12. The antenna system of claim 11, comprising one or more active components, said active components individually selected from the group consisting of: an NPN transistor, variable capacitor, varactor diode, MOSFET, and a switch.

13. The antenna system of claim 12, wherein at least one of said active components is coupled to the isolated magnetic dipole antenna.

14. The antenna system of claim 12, wherein at least one of said active components is coupled to the second antenna element.

15. The antenna system of claim 12, comprising four feed ports, said four feed ports including a first high frequency port, a second high frequency port, a first low frequency port, and a second low frequency port; each of said feed ports being individually coupled to one of four corresponding power amplifiers; at least one of said feed ports further coupled to an active component for tuning frequency response of the antenna and an associated antenna tuning module for controlling the active component; wherein the antenna system is configured for optimization at one or more of the four feed ports.

* * * * *